US009701457B2

(12) United States Patent
Unwin

(10) Patent No.: US 9,701,457 B2
(45) Date of Patent: Jul. 11, 2017

(54) SELF ADHESIVE BAGS FOR STEAM COOKING IN A MICROWAVE OVEN

(76) Inventor: Guy Darell Unwin, Gloucestershire (GB)

( * ) Notice: Subject to any disclaimer, the term of this patent is extended or adjusted under 35 U.S.C. 154(b) by 391 days.

(21) Appl. No.: 13/581,825

(22) PCT Filed: Feb. 28, 2011

(86) PCT No.: PCT/GB2011/000268
§ 371 (c)(1),
(2), (4) Date: Aug. 30, 2012

(87) PCT Pub. No.: WO2011/107727
PCT Pub. Date: Sep. 9, 2011

(65) Prior Publication Data

US 2012/0321765 A1 Dec. 20, 2012

(30) Foreign Application Priority Data

Mar. 1, 2010 (GB) ..... 1003368.6

(51) Int. Cl.
*B65D 77/22* (2006.01)
*B65D 81/34* (2006.01)

(52) U.S. Cl.
CPC ..... *B65D 77/225* (2013.01); *B65D 81/3461* (2013.01); *B65D 2581/3427* (2013.01)

(58) Field of Classification Search
CPC ..... B65D 77/225
(Continued)

(56) References Cited

U.S. PATENT DOCUMENTS 3,027,261 A 3/1962 Samara
3,323,442 A * 6/1967 Rader ..... A47J 36/022 383/103

(Continued)

FOREIGN PATENT DOCUMENTS

CA 2597828 2/2009
DE 202005017945 U 1/2006

(Continued)

OTHER PUBLICATIONS

Purdue University, Microwave cooking meat, [on line] 2002—no month given, retrieved Nov. 10, 2014. Retrieved from the Internet: URL<http://www.four-h.purdue.edu/foods/Microwave%20cooking%20meat.htm>.*

(Continued)

*Primary Examiner* — Erik Kashnikow
*Assistant Examiner* — C Smith
(74) *Attorney, Agent, or Firm* — Walters & Wasylyna LLC

(57) ABSTRACT

According to the present invention there is provided a flexible container for use by the end user as a cooking utensil. Said container comprises a front and rear panel formed of a food safe material and sealed at three sides, the rear panel being extended beyond the front panel on the unsealed fourth side to form a flap. On the upper side of the flap is formed an adhesive strip provided with a removable cover strip intended to be removed by the user when closing the container. The user is instructed to fold the container across both layers rather than simply across the junction of the flap and front panel in order to seal it prior to cooking. This creates a container which is effectively sealed but which is capable of releasing excess pressure above that level needed to steam the contents thoroughly. At the opposite end and sides of the container, away from the flap, a (Continued)

second weld parallel to the sealed edge may be formed on one or more sides in order to create an area which is not subject to the steam effect which occurs when food is heated, thus forming a cooler area for handling by the user when the product is cooked and removed from the microwave oven.

9 Claims, 2 Drawing Sheets

(58) Field of Classification Search
USPC ..... 426/113, 234; 383/104
See application file for complete search history.

(56) References Cited

U.S. PATENT DOCUMENTS

| | | | | |
|---|---|---|---|---|
| RE28,317 | E | 1/1975 | Goodrich | |
| 3,973,045 | A | 8/1976 | Brandberg et al. | |
| 4,874,620 | A | 10/1989 | Mendenhall et al. | |
| 4,987,280 | A | 1/1991 | Kanafani et al. | |
| 6,384,391 | B1 | 5/2002 | Beckwith | |
| 2001/0043971 | A1 | 11/2001 | Johns | |
| 2005/0230384 | A1 | 10/2005 | Robison et al. | |
| 2006/0257056 | A1 | 11/2006 | Miyake et al. | |
| 2008/0247683 | A1* | 10/2008 | Schmal et al. | 383/104 |
| 2009/0175563 | A1 | 7/2009 | Weaver | |

FOREIGN PATENT DOCUMENTS

| | | | | |
|---|---|---|---|---|
| EP | 1661821 | | 5/2006 | |
| EP | 1661821 | A1 | 5/2006 | |
| EP | 1867583 | | 10/2006 | |
| EP | 1880954 | | 11/2006 | |
| FR | 002799734 | A1 | 4/2001 | |
| FR | 002874207 | A1 | 2/2006 | |
| GB | 2252482 | | 8/1992 | |
| GB | 2252482 | A | 8/1992 | |
| GB | 2415684 | | 1/2006 | |
| GB | 2415684 | A | 1/2006 | |
| JP | 2000 327047 | | 11/2000 | |
| JP | 2000327047 | A | 11/2000 | |
| JP | 2003-72777 | * | 3/2003 | B65D 30/16 |
| JP | 2006111327 | | 4/2006 | |
| JP | 2006321519 | | 11/2006 | |
| JP | 2006327590 | | 12/2006 | |
| JP | 2007137478 | | 6/2007 | |
| JP | 2007191199 | | 8/2007 | |
| JP | 2007204072 | | 8/2007 | |
| JP | 2007284118 | | 11/2007 | |
| JP | 2007331816 | | 12/2007 | |
| WO | WO 02/080623 | | 10/2002 | |
| WO | WO 2009/146324 | | 12/2009 | |

OTHER PUBLICATIONS

Veggie Option, Birds Eye Steamfresh, [on line] Aug. 2011, retrieved Nov. 11, 2014. Retrieved from the Internet: URL<http://veggieoption.blogspot.com/2011/08/new-product-birds-eye-chefs-favorites.html>.*

JP 2003-72777, 2003-72777 Machine Translation.*

New Plastic Bags Biodegrade in Four Months, Popular Science, [on line] Apr. 18, 2008, retrieved May 8, 2015. Retrieved vrom the Internet: URL:<http://www.popsci.com/environment/article/2008-04/biodegradable-plastics>.*

Corn Plastic to the Rescue, Smithsonian.com, [on line] Aug. 2006, retrieved May 8, 2015. Retrieved from the Internet: URL<http://www.smithsonianmag.com/science-nature/corn-plastic-to-the-rescue-126404720/?all>.*

International Search Report for PCT/GB2011/000268 (Jan. 9, 2011).

Australian Examination Report, AU2011222758 (2013).

European Examination Report, EP 11 722 850.2-1708 (2013).

Combined Search and Examination Report, GB1003368.6 (2010).

Response to European Examination Report, EP 11 722 850.2 (2014).

Response to Australian Examination Report, AU2011222758 (2014).

* cited by examiner

SELF ADHESIVE BAGS FOR STEAM COOKING IN A MICROWAVE OVEN

This is a U.S. national phase application of Intl. Pat. App. No. PCT/GB2011/000268 filed on Feb. 28, 2011, which claims priority from GB1003368.6 filed on Mar. 1, 2010.

This invention relates to improvements in the cooking of food in a microwave oven, whereby food can be cheaply and effectively cooked by steaming the food in a self venting bag without losing the nutritional value of the food.

The background to the invention is that since the advent of the microwave oven there has been considerable interest in providing a container for food, particularly industrially packaged food suitable for use in a microwave oven, which is capable of maintaining a positive pressure and thus steaming the food as in a pressure cooker. As is well known, cooking of food in a pressurized container accelerates the heating effect and thus saves energy. However, the manufacture of a flexible container capable of withstanding the pressure generated and at the same time providing a clean and efficient means of allowing the escape of water vapour usually means that the package becomes expensive to produce. In addition, the problems associated with re-use are considerable, causing such a product to be both expensive to manufacture and difficult to re-use. The present invention is designed for the consumer rather than the packaged food industry as a cheap, quick and easy means of cooking.

Searches have produced many instances of prior art, but none which appear to provide a container inexpensive enough for single use by the consumer and capable of being re-usable. WO 2009146324 KOENIGKRAMER discloses a simple container featuring interlocking zip fittings to front and back walls, one part of which is relatively weak in order to vent excess pressure. EP 1880954 KANZAKI reveals a heat sealed pouch package whose seal is weaker by virtue of being less wide in one place than in the remainder of the seal while EP 1867583 NISHI shows a bag which releases excess steam, unfortunately without revealing the mechanism. There are many applications for grant of a patent, particularly from Japan, where the staple food of rice can be advantageously cooked in the user's microwave oven. However, none of the applications found appear to have been granted. Further examples include US 2006257056 MIYAKE which features a Z-shaped seal at one end which has a weaker section incorporated therein, JP 2007331816 HARUNA which shows a laminated construction featuring a pressure release vent chipped into the edge seal, JP 2007284118 MIYAKE which tells of a bag folded at one end and provided with a steam release vent and easy separable tape, JP 2007204072 NAKANAGA which reveals a resin based container provided with a vent formed by the juxtaposition of a heat sealed and an adhesively sealed seam and JP 2007191199 TAKEDA et al which discloses a bag with a flap that is variably sealed to the opposite face of the container in order to produce an unsealed zone connected to a vent. Other references include JP 2007137478 ITO et al, JP 2006327590 KAWAMOTO et al, JP 2006321519 SUGIYAMA et al, and JP 2006111327 ARAKI et al.

CA 2597828 MACDONALD teaches of a laminated bag whose laminates interlock along a seam forming a steam vent which will open when the pressure mounts inside the container. WO 02080623 THOMPSON reveals a microwaveable bag comprising two layers with an absorbent material between them while U.S. Pat. No. 4,987,280 KANAFANI discloses a sealed bag containing a sealed packet of an aqueous solution and a food product, the packet being intended to rupture and thereby steam the contents when heated. US 2001043971 JOHNS shows a sealed bag packaged with a food product and having an absorbent material on top of the food product while U.S. Pat. No. 4,874,620 MENDENHALL discloses a ventable sealed package comprising inner permeable and outer impermeable layers with gussets at the side and an arrangement of perforations and slits that permit venting from the external layer. All of these inventions suffer from deficiencies that the present invention seeks to overcome.

According to the present invention there is provided a flexible container for use by the end user as a cooking utensil. Said container comprises a front and rear panel formed of a food safe material and sealed at three sides, the rear panel being extended beyond the front panel on the unsealed fourth side to form a flap. On the upper side of the flap is formed an adhesive strip provided with a removable cover strip intended to be removed by the user when closing the container. The user is instructed to fold the container across both layers rather than simply across the junction of the flap and front panel in order to seal it prior to cooking. This creates a container which is effectively sealed but which is capable of releasing excess pressure above that level needed to steam the contents thoroughly. At the opposite end and sides of the container, away from the flap, a second weld parallel to the sealed edge may be formed on one or more sides in order to create an area which is not subject to the steam effect which occurs when food is heated, thus forming a cooler area for handling by the user when the product is cooked and removed from the microwave oven. The user places the foodstuff in the container, removes the removable cover of the sealing strip and folds the flap and a part of both layers before pressing the strip onto the upper panel of the container to seal the package and then places said container in the microwave oven to cook for the requisite time. On removal from the oven the user unseals the flap and removes the foodstuff.

The container will be made in a range of sizes but will typically be of a size less than the diameter of an average domestic microwave oven in order to allow it to rotate freely when being heated in said oven. A diagonal measurement of 320 mm from corner to corner of the container will therefore be practical, resulting in a maximum length of 240 mm, although other sizes may be required for other types of oven. The container may be formed in a variety of ways but will in practice be made by sealing a front panel and a rear panel either by welding or adhesive means. The adhesive strip and its protective covering strip will typically be applied together to the top flap after the container is formed. Any secondary seals to form handling sections may be formed in the same process as the formation of the container or may be formed subsequently. The adhesive strip attached to the flap will typically extend across the full width of the top flap but may extend across a lesser proportion thereof without substantially altering its effectiveness.

When the container is placed in the microwave oven and subjected to the heating effect therein any water content in the food will begin to turn to steam and thereby inflate the container. If required, water may be added but in general this step is not required. When this inflation occurs the fold where the top flap has been folded onto the front panel of the container increasingly tightens against the pressure thus improving the sealing effect. The design attempts to retain the generated pressure but having only a partial seal the pressure is slowly released as said pressure increases, thereby preventing rupture of the container. The vented steam passes through the fold into the area formed between the flap, the front panel of the container and the adhesive sealing strip and thence out to atmosphere at the distal edges of said area. This simple mechanism has been found to work extremely well without recourse to more complex contrivances adopted in other patent applications.

The container thus formed is simple enough to make inexpensively for sale in a multiple package as a single use product, although in tests it has been found that each container is capable of reuse several times. It ideally features printing on the front face to indicate at least the means of use and to mark the ideal line at which to fold the container prior to use. It can be made of an organic and biodegradable material such as corn starch or cellulose and thus avoids the waste generated by using a plastic material like polyethylene which is used in bags sealed by an interlocking zip strip as featured in KOENIGKRAMER. Alternative means of sealing the front and rear panels to each other may be employed and the handling sections at each of the three sealed sides may be created by means other than heating, such as an adhesive coating.

The method of use of the invention therefore comprises the following steps:

placing the foodstuff into the container;

removing the protective strip attached to the adhesive strip;

folding the top flap to meet the front panel of the container across front and rear panels;

securing the top flap to the front panel by means of the adhesive strip;

placing the container into a microwave oven;

energising the oven for the required time;

removing the container from the microwave oven;

detaching the top flap from the front panel of the container by pulling apart the adhesive bond;

removing the cooked foodstuff from the container and;

placing the foodstuff on a plate or other receptacle.

In the following drawings it is not intended to exclude features from another Figure from each specific embodiment but rather to provide a basis for their combination in specific applications.

While the invention has been disclosed in its preferred form, it is to be understood that the specific embodiment thereof, as described and illustrated herein, is not to be considered in a limited sense, as there may be other forms or modifications of the invention which should also be construed to come within the scope of the appended claims.

Specific embodiments of the invention will now be described by way of example with reference to the accompanying drawings in which.

Figure 1:
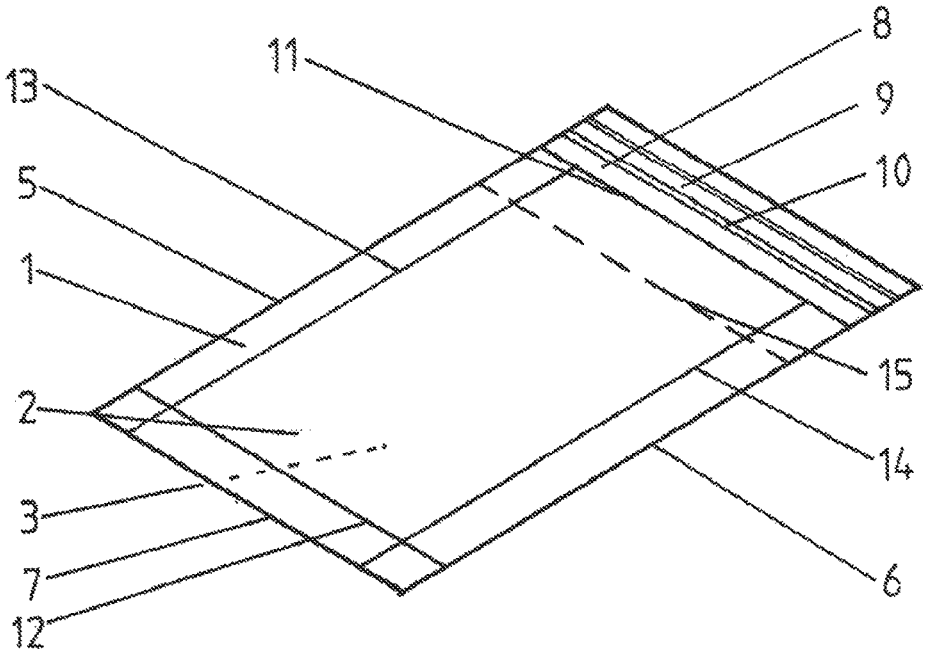
FIG. 1 shows the essential features of the invention.

Referring to the drawings, FIG. 1 shows the container 1 comprising front panel 2 and rear panel 3, edges 5 and 6, end seal 7, flap 8, adhesive strip 9 and removable strip 10, top margin 11 of front panel 2, second seal 12 and secondary side seals 13 and 14 and printed fold line 15.

Figure 2:
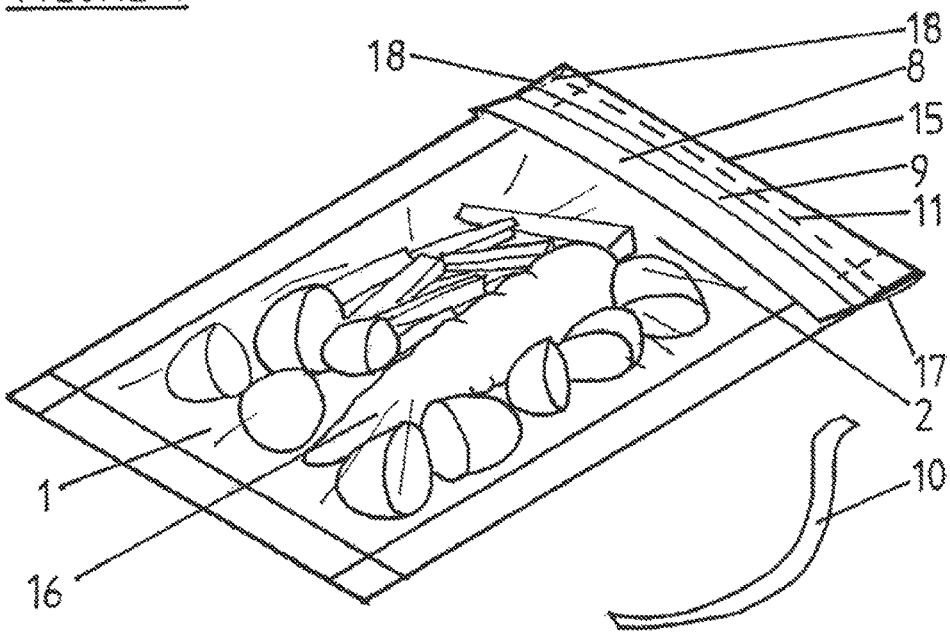
FIG. 2 shows the invention in its sealed state with a full width adhesive sealing strip.

FIG. 2 shows the container 1 in its folded state where the flap 8 has been folded along the printed fold line 15. The removable strip 10 has been removed and the flap 8 has been pressed down onto the front panel 2 to attach the adhesive strip 9 to said front panel 2. An assortment of vegetables 16 is shown contained within the container 1 ready for heating in the oven. On heating, escaping steam from the vegetables will pass the partial seal formed by the fold at the printed fold line 15 and outwards to atmosphere through the unsealed areas 17 and 18. The top margin 11 of front panel 2 is shown for clarity.

Figure 3:
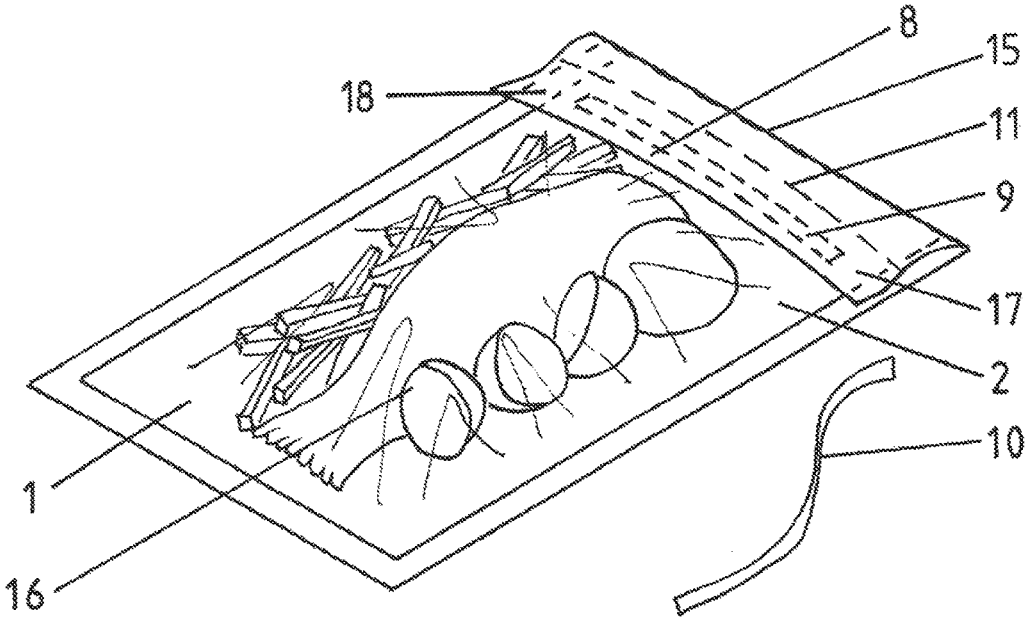
FIG. 3 shows the invention in its sealed state with an adhesive sealing strip covering a portion of the width.

FIG. 3 shows the container 1 in its folded state where the flap 8 has been folded along the printed fold line 15. The removable strip 10 has been removed and the flap 8 has been pressed down onto the front panel 2 to attach the adhesive strip 9 to said front panel 2. The adhesive strip 9 attached to the flap 8 extends across a lesser proportion of the width of the flap 8. An assortment of vegetables 16 is shown contained within the container 1 ready for heating in the oven. On heating, escaping steam from the vegetables will pass the partial seal formed by the fold at the printed fold line 15 and outwards to atmosphere through the unsealed areas 17 and 18. The top margin 11 of front panel 2 is shown for clarity.

The invention claimed is:

1. A method for cooking foodstuff in a container made of at least one sheet of food grade microwave transparent non-insulating material, the container comprising a front panel, a rear panel sealed to the front panel at three sides to form a bag with a mouth, the rear panel being longer than the front panel and extending beyond the front panel at an unsealed fourth side to define a flap, and an adhesive strip positioned on an upper side of the flap between a top margin of the front panel and a top margin of the rear panel, the adhesive strip being covered by a removable covering strip, the method comprising the steps of:

placing the foodstuff into the container;

removing the removable covering strip from the adhesive strip;

folding the bag across both the front panel and the rear panel to form a fold comprising the front panel and the rear panel;

connecting the flap to the front panel with the adhesive strip to maintain the fold;

placing the container into a microwave oven;

energising the oven for a cooking time;

removing the container from the microwave oven;

detaching the flap from the front panel of the container;

removing the cooked foodstuff from the container; and placing the foodstuff on a plate or other receptacle.

2. The method of claim 1 wherein the container further comprises a printed fold line extending across the bag, and wherein the folding the bag across both the front panel and the rear panel to form the fold comprises folding along the fold line.

3. The method of claim 1 wherein the flap extends across a full width of the container, and wherein the adhesive strip extends across the full width.

4. The method of claim 1 wherein the food grade microwave transparent non-insulating material comprises at least one of polypropylene, polyethylene, polyester, and nylon.

5. The method of claim 1 wherein the container comprises at least one of corn starch and cellulose.

6. The method of claim 1 wherein the container comprises a secondary seal parallel with the sealed side edge at any of the other three sides to prevent ingress of steam to that portion of the container between the sealed edge and the secondary seal in order to form a handle which remains cool to the touch.

7. The method of claim 1 wherein the food grade microwave transparent non-insulating material is capable of withstanding temperatures up to 230 degrees Centigrade.

8. The method of claim 1 wherein the flap extends across a full width of the container, and wherein the adhesive strip extends across only a portion of the full width.

9. A method for cooking foodstuff in a container made of at least one sheet of food grade microwave transparent non-insulating material, the container comprising a front panel, a rear panel sealed to the front panel at three sides to form a bag with a mouth, the rear panel being longer than the front panel and extending beyond the front panel at an unsealed fourth side to define a flap, and an adhesive strip extending across at least a portion of a width of an upper side of the flap between a top margin of the front panel and a top margin of the rear panel, and a fold line printed on the front panel, the method comprising the steps of:

placing the foodstuff into the container;

folding the bag along the fold line to form a fold comprising the front panel and the rear panel;

connecting the flap of the rear panel to the front panel with the adhesive strip;

placing the container into a conventional oven;

energising the oven for the required time;

removing the container from the oven;

detaching the flap from the front panel of the container;

removing the cooked foodstuff from the container; and placing the foodstuff on a plate or other receptacle.

* * * * *